United States Patent [19]

Baisden

[11] Patent Number: 4,523,684

[45] Date of Patent: Jun. 18, 1985

[54] CRANE TOOL FOR ATTACHMENT TO A BACKHOE ARM

[76] Inventor: Jerry Baisden, 2758 Merritt St., Springfield, Ohio 45503

[21] Appl. No.: 431,503

[22] Filed: Sep. 30, 1982

[51] Int. Cl.[3] ..... B66C 23/04

[52] U.S. Cl. ..... 212/175; 212/261; 212/264; 414/912

[58] Field of Search ..... 212/175, 177, 179, 180, 212/238, 242, 244, 255, 261, 259, 264, 265, 230, 231, 267; 414/718, 724, 912; 37/117.5

[56] References Cited

U.S. PATENT DOCUMENTS

| | | | |
|---|---|---|---|
| 168,784 | 10/1875 | Roberts | 212/244 |
| 2,902,177 | 9/1959 | Stoddard et al. | 212/251 |
| 2,917,189 | 12/1959 | Isaacs | 212/244 |
| 3,527,362 | 9/1970 | Allen | 212/238 |
| 3,780,779 | 12/1973 | Guy | 144/193 A |
| 3,828,941 | 8/1974 | Coutinho | 212/261 |
| 3,866,759 | 2/1975 | Lucas | 212/261 |
| 4,073,325 | 2/1978 | Krom, Jr. | 144/193 A |
| 4,426,782 | 1/1984 | Baisden | 30/379.5 |

*Primary Examiner*—Galen L. Barefoot
*Assistant Examiner*—Stephen P. Avila
*Attorney, Agent, or Firm*—Biebel, French & Nauman

[57] ABSTRACT

A crane tool attachment is provided for removable mounting to the arm of a backhoe from which the bucket has been removed. A frame is fittable on the backhoe arm at its outer end and is fastened thereto. A sleeve is mounted to the frame so as to be directed substantially parallel to the backhoe arm, and a boom is insertable through and moveable along the sleeve. The inner end of the boom is connected to a hydraulic cylinder disposed along the backhoe arm normally for pivoting the bucket when in place, for moving the boom along the sleeve. A hydraulically-powered winch with a cable is mounted to the sleeve and is connected to a source of hydraulic fluid under pressure within the backhoe machine. A pulley is mounted for rotation at the outer end of the boom for passage of the cable therearound, and a hook is connectable to the free end of the cable.

4 Claims, 5 Drawing Figures

CRANE TOOL FOR ATTACHMENT TO A BACKHOE ARM

BACKGROUND OF THE INVENTION

The present invention relates to a crane tool for attachment to the arm of a conventional backhoe machine, and more particularly, to such a tool that may be used in conjunction with the hydraulic system of the backhoe for operation thereby.

Many tasks require the use of a powered crane for lifting and/or lowering objects. In addition, many other tasks could be facilitated through use of a crane. The high cost of such machinery, however, makes acquiring a crane for such jobs economically impossible or impractical for many businesses and individuals.

Often, those who perform tasks in which a crane could be useful own or have access to a conventional backhoe tractor. As is disclosed in U.S. Pat. No. 4,426,782, issued Jan. 24, 1984 to Baisden, an attachment can be mounted to the backhoe arm of the machine after the bucket has been removed that will enable the mounting to and operation by the machine of a number of different tools. Examples disclosed therein include tools for splitting wood and for cutting reinforcing rod or sections of pipe. It would seem that such an attachment could provide a means for enabling many businesses and individuals to obtain the use of a powered crane without the expense of purchasing and maintaining a machine dedicated to that function.

What is needed, therefore, is a crane tool that is adaptable for removable attachment to the arm of a backhoe machine. Such a tool may be operated by the machine mechanism, and should be adapted for easy mounting to and dismounting from the backhoe arm. Moreover, the tool should be designed so as to be used with a multi-purpose attachment that is suitable for mounting a plurality of other tools. Additionally, the tool should be of relatively simple construction, thereby making it relatively inexpensive.

SUMMARY OF THE INVENTION

The present invention provides a crane tool attachment for removable mounting to the arm of a backhoe machine from which the bucket has been removed. The backhoe includes a controllable source of hydraulic fluid under pressure, normally supplied to a hydraulic cylinder on the backhoe arm, but disconnectable therefrom. The crane attachment has a boom, along with means removably mounting the boom to the backhoe arm such that the boom extends outwardly from the arm in a direction substantially parallel thereto. A hydraulically driven winch is mounted to the mounting means for playing out and retracting a cable, and the winch is connected with the source of hydraulic fluid for driving of the winch. A pulley is mounted for rotation at the outer end of the boom for passage of the cable therearound, and a hook is connected to the free end of the cable.

The means mounting the boom to the backhoe arm may include a frame fitable on the arm at its outer end and extending at least slightly therebeyond, a sleeve through which the boom is insertable, and means mounting the sleeve to the frame. The winch is then mounted to the sleeve.

The frame may include an opening therein substantially at its outer end, and the means for mounting the sleeve to the frame includes a bar depending downwardly from the sleeve. The bar is insertable into the opening in the frame.

The backhoe machine may also include a hydraulic cylinder disposed along the arm normally for pivoting the bucket when in place on the arm. The frame may then include a sliding member connectable with the end of the cylinder for movement thereby along the frame, as well as a guide means for directing the sliding member along the frame. The inner end of the boom is then connected with the sliding member, for movement by the cylinder within the sleeve.

The boom of the crane attachment may include a plurality of telescoping sections, the innermost of the sections having the pulley mounted to its outer end, and the outermost of the sections being connected at its inner end to the sliding member. Provision is made for selectively retaining the sections in their relative positions.

Accordingly, it is an object of the present invention to provide a crane tool attachment for removable mounting to the arm of a conventional backhoe tractor; to provide such a crane tool that may be powered by the hydraulic system of the tractor; to provide such a crane tool that may be readily mounted to and dismounted from the backhoe arm; to provide such a tool that may be used in conjunction with a multi-purpose attachment for mounting a variety of different tools; and to provide such a tool that is relatively simple and inexpensive to construct.

Other objects and advantages will be apparent from the following description, the accompanying drawings and the appended claims.

DETAILED DESCRIPTION OF THE PREFERRED EMBODIMENT

Figures 1, 2, 5:
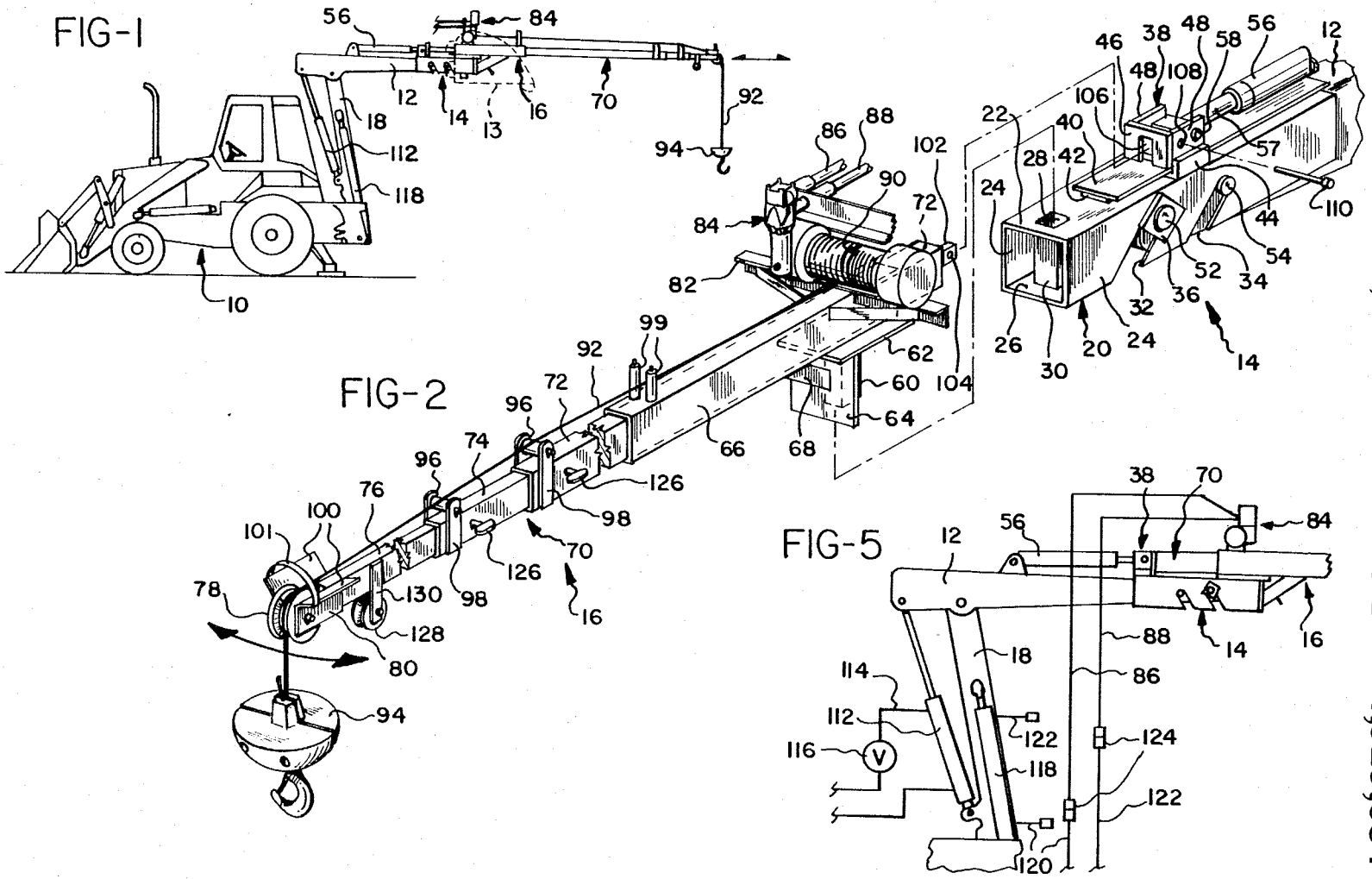
FIG. 1 is an elevational view showing the crane tool attachment of the present invention mounted to a conventional backhoe tractor.
FIG. 2 is a perspective view showing connection of the crane tool to the attachment.
FIG. 5 is a schematic view showing the connection of hydraulic fluid supply lines for operation of the crane tool.

Referring to FIG. 1, the present invention provides a crane tool and attachment for removable mounting to a conventional backhoe tractor 10, whereby the tractor 10 is quickly converted for use as a powered crane. The device is mounted to the outer segment 12 of the backhoe arm, from which the bucket 13 has been removed and includes an attachment portion 14 and a crane tool portion 16. When the device is in use, the backhoe arm is held in a position with its inner portion 18 in the upward-most orientation. The outer portion 12 may then be positioned in a manner convenient for the use of crane tool 16.

Figure 3:
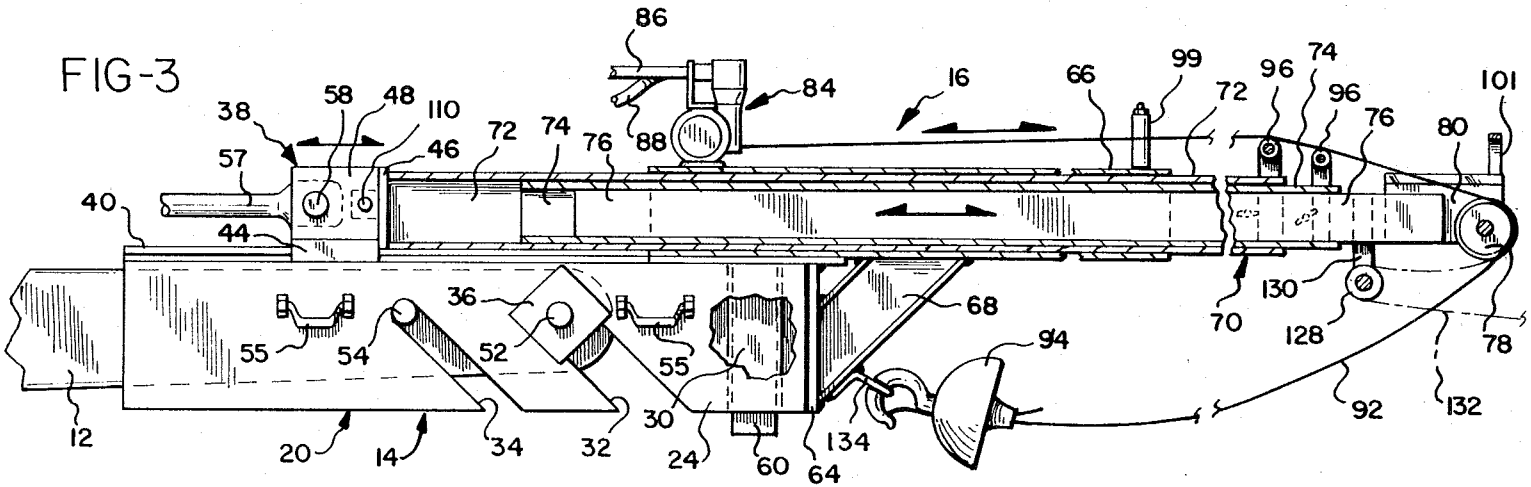
FIG. 3 is an elevational, partially sectional view taken generally along line 3—3 of FIG. 4.
Figure 4:
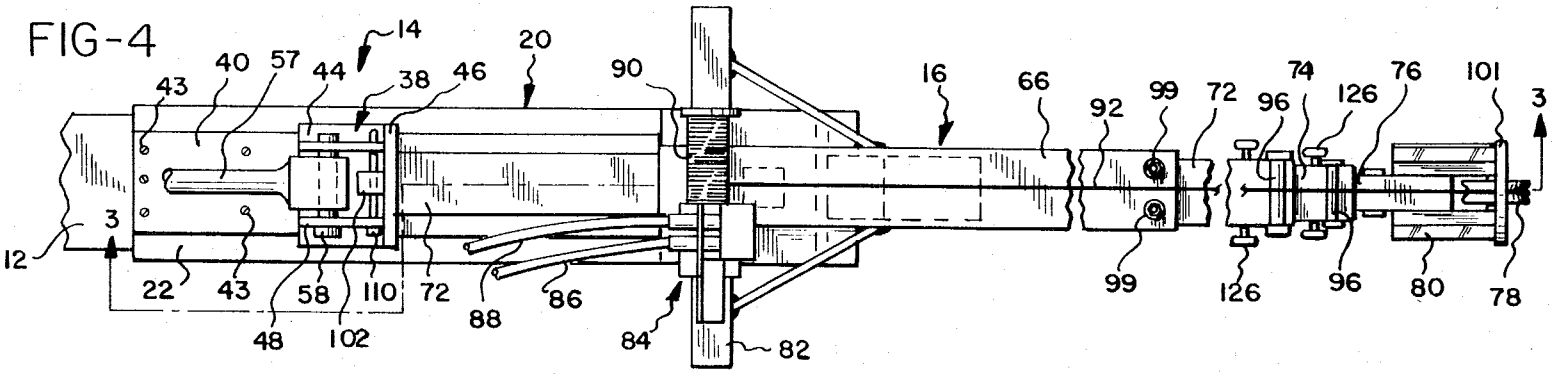
FIG. 4 is a top plan view of the crane tool and attachment in a connected state.

The attachment 14 and the crane tool 16 of the present invention are shown in greater detail in FIGS. 2, 3 and 4. Attachment 14 is substantially identical to that disclosed in U.S. Pat. No. 4,426,782, issued Jan. 24, 1984 to Baisden which is hereby incorporated by reference. Attachment 14 mounts to the backhoe arm 12, and includes a frame 20 having a base 22 and a pair of attached side members 24. Frame 20 is preferably constructed from a length of steel square tube stock, from which all but a portion of one side of the tube is cut. The shortened side forms a bottom member 26 connected between side members 24 at one end of frame 20.

An opening 28 is defined in base 22, with a similar opening defined through bottom member 26. A length of square tube stock 30 is connected between the openings 28.

Each side member 24 of frame 20 includes a pair of slots 32 and 34 extending in a diagonal fashion from the bottom edge of side member 24 partially across the height of side member 24. A plate 36 having a hole defined therethrough is mounted over the closed end of slot 32.

A sliding member 38 directed by a guide means is mounted along the base 22 of frame 20. The guide means includes a guide member 40, and a spacer 42 disposed between guide member 40 and base 22. Guide member 40 and spacer 42 are secured to base 22 by a plurality of bolts 43 (not shown in FIG. 4) extending through guide member 40 and spacer 42 into base 22.

Sliding member 38 includes support portion 44 provided for movement along guide member 40 and for maintaining a plate member 46 in an orientation perpendicular to base 22. Plate member 46 is mounted to support portion 44, further supported by a pair of side plates 48 also mounted to support portion 44. Support portion 44 further includes an opening defined along the bottom thereof, with a groove extending along each wall of the opening, so that a cross-section of the opening taken parallel to plate member 46 is substantially T-shaped. The opening and grooves are sized so as to cooperate with guide member 40 and spacer 42 such that sliding member 38 is retained thereon and may be directed along the length of base 22 of frame 20.

A typical outer arm segment 12 from which the backhoe bucket has been removed includes a pair of holes passing through arm 12 into which removable pins 52 and 54 are insertable, normally for securing the bucket. To mount the attachment 20 to the arm 12, pin 54 is inserted or left in place in the arm 12, and the frame 20 is placed onto arm 12 such that pin 54 enters and moves to the end of each slot 34 of the side members 24. It will be seen that frame 20 is then pivotable about pin 54, and thus frame 20 may be mounted from a number of initial orientations of frame 20, thereby facilitating its mounting upon arm 12. Once frame 20 has been moved into proper position, i.e., with base 22 parallel to the upper surface of arm 12, the holes of the side plate 36 on each side member 24 will align with the hole in the arm 12 provided for pin 52. Pin 52 may then be inserted, securing frame 20 into position.

To facilitate placing and positioning of the frame 20 on arm 12, as well as movement of attachment 14 when not in use, a pair of fold down handles 55 (shown in FIG. 3 only) are mounted to each of the side members 24.

The backhoe machine 10 further includes a hydraulic cylinder 56 having a rod 57 entendable and retractable along arm 12, provided for pivoting of the backhoe bucket when mounted to the end of arm 12. A hole is provided through a knuckle at the end of rod 57, through which a removable pin 58 is insertable, normally used for securing the rod 57 to the bucket. Once frame 20 is securely in place upon arm 12, the end of rod 57 is placed between the side plates 48 carried by the support portion 44 of sliding member 38. A hole is provided in each of the side plates 48, disposed so as to cooperate with the hole in the end knuckle of rod 57 for insertion of pin 58 thereinto. The connection of rod 57 to sliding member 38 enables entension and retraction of the cylinder 56 by the backhoe operator to move sliding member 38 in either direction along guide member 40.

The crane tool 16 in turn mounts to the attachment 14 after attachment 14 has been secured to the arm 12. As seen in FIGS. 2 and 3, tools 16 includes a length of square bar 60 which is welded at one end to a plate 62. Mounting of tool 16 to attachment 14 is effected by insertion of bar 60 into tube 30 until plate 62 rests upon base 22 of frame 20. A plate 64 is welded to plate 62 so as to depend downward perpendicular to plate 62, so that when tool 16 is in place on attachment 14, plate 64 is adjacent the outer end of frame 20.

A sleeve 66, formed from a length of square tubing is welded onto plate 62 so as to extend outwardly from arm 12 when tool 16 is in place on attacment 14 in a direction parallel to the direction of movement of sliding member 38. A gusset beam 68 is attached between plate 64 and sleeve 66, to give additional support to sleeve 66.

A boom 70 is inserted into sleeve 66, and consists of three telescoping sections 72, 74 and 76. Each section 72, 74 and 76 is constructed from a length of square tubing of progressively smaller diameter so as to nest in extendable fashion within the sleeve 66. A pulley 78 is mounted for rotation between a pair of plates 80, each attached to the outer end of boom section 76.

A support frame 82 is mounted to the top of sleeve 66 substantially opposite bar 60. Frame 82 supports a hydraulically-powered winch 84, which may be any commercially available winch of sufficient capacity, such as that manufactured by Ramsey Winch Co. of Tulsa, Okla. Winch 84 is connected to hydraulic input line 86 and hydraulic output line 88, whereby hydraulic fluid under pressure is supplied to winch 84 for energization.

Winch 84 includes a drum 90 for carrying a length of cable 92. Energization of winch 84 causes drum 90 to be rotated, whereby the cable 92 is either played out or retracted. Cable 92 is extended along the length of sleeve 66 and the portion of boom 70 extending therefrom and passes around pulley 78 at the outer end of the boom 70. A hook 94 is attached to the end of cable 92 for use in lifting and lowering objects with the crane tool 16.

A pair of horizontal rollers 96, each mounted for rotation between a pair of support members 98, are mounted to boom sections 72 and 74 at the outer end of each for supporting the cable 92 along the boom 70. A pair of vertical rollers 99 are mounted to the top of sleeve 66 with one roller 99 disposed on each side of cable 92 for directing cable 92 along sleeve 66 and boom 70. Additionally, each plate 80 includes a flange portion 100, the flange portions 100 being connected by strap member 101, for preventing cable 92 from leaving boom 70 in the event it should slip off pulley 78.

The inner end of boom section 72 has a portion 102 projecting therefrom having a hole 104 defined therethrough. As best seen in FIG. 2, plate member 46 of sliding member 38 includes a slot 106 defined in the face thereof. When the tool 16 is mounted to the attachment 14, boom 70 may be moved inwardly along sleeve 66 so that projection 102 is inserted into slot 106. A pair of holes 108 are provided in the side plates 48 of sliding member 38 so as to cooperate with hole 104 in projection 102. A pin 110 is insertable through holes 108 and 104, whereby the boom 70 is then secured to sliding member 38.

The construction of the crane tool 16 and attachment 14 will be better appreciated through consideration of the operation of the backhoe 10 with crane tool 16. Initially, the bucket is removed from the outer arm segment 12 of the backhoe 10, and the attachment 14 is mounted to arm portion 12 as has been described herein. Crane tool 16 is then mounted to attachment 14, with the boom 70 connected to sliding member 38. Arm segment 18 of the backhoe 10 is then moved to its uppermost position, and arm segment 12 is placed in the desired position.

As seen schematically in FIG. 5, the crowd cylinder 112, which is operative to pivot outer arm segment 12 on inner arm segment 18, includes a hydraulic fluid supply line 114 extending from cylinder 112 to the hydraulic fluid supply source (not shown) of backhoe 10. A cut-off valve 116 is disposed within supply line 114, and is actuated to prevent fluid flow through line 114. Valve 116 prevents seepage of fluid from cylinder 112, thereby preventing arm segment 12 from sinking during operation of crane tool 16. It should be noted that valve 116 is not typically included in supply line 114 as the backhoe 10 is manufactured, and thus must be added by the user of crane tool 16.

Of course, arm segment 12 may be moved as necessary during operation of crane tool 16 to aid in lifting and/or lowering objects therewith. In such a case, however, valve 116 must be opened prior to operation of cylinder 112 for movement of arm segment 12, and then closed following such movement.

Additionally, a pair of cylinders 118 (only one shown) are connected to each side of arm segment 18 for vertical pivotal movement thereof with respect to the backhoe frame. Fluid supply lines 120 and 122 extend from the fluid supply source to cylinders 118, and include a quick-disconnect coupler 124 in each line 120 and 122. Once the arm portion 18 has been positioned as shown in FIG. 5, and mechanically locked in place, couplers 124 are disconnected. Lines 120 and 122 are connected by similar couplers to supply lines 86 and 88 leading to winch 84. Thus, winch 84 may be operated by the controls provided normally for operating cylinders 118.

While not shown in FIG. 5, the fluid supply lines to hydraulic cylinder 56 remain connected in normal fashion during operation of crane tool 16. Since boom 70 is attached to sliding member 38 which is in turn connected to cylinder 56, operation of the cylinder 56 enables the boom 70 to be moved along the sleeve 66. Thus, during operation of crane tool 16, cylinder 56 provides for extension and retraction of boom 70.

Further, it will be recalled that boom 70 is constructed of three telescoping sections 72, 74 and 76. Sections 72 and 74 each include a winged bolt 126 on one or both sides of sections 72 and 74 at the outer ends thereof. Bolts 126 threadingly engage the sections to which they are mounted, and tightening of one of bolts 126 causes the bolt to be driven against the next inward boom section, thereby locking the two sections into relative position.

The sections 72, 74 and 76 of boom 70 may be extended or retracted in either of two ways. The sections may be extended or retracted manually, with bolts 126 being loosened, the sections being positioned, and the bolts being retightened. Additionally, crane tool 16 includes provision for extending and retracting the boom sections through use of the crane tool mechanism.

A second pulley 128 is removably mounted between a pair of bracket plates 130 so as to be suspended beneath the outer end of boom section 76. Pulley 128 is removed from bracket 130, cable 92 is passed around pulley 128, which is then replaced into brackets 130 so that cable 92 follows the path indicated by dashed-line 132 in FIG. 3. Cable 92 is then extended by winch 84 until hook 94 can be connected to a stationary object such as a parked vehicle, a building or the like. Tension on cable 92 is released by winch 84, and boom 70 is moved outwardly by cylinder 56 to the fullest possible extent. Cable 92 is then retracted until placed under tension, and the appropriate bolt 126 for the section of boom 70 adjacent that to be extended is loosened. Cylinder 56 then retracts boom 70 to the fullest extent. The tension in cable 92 passing about both pulleys 78 and 128 causes boom section 76 to remain in a fixed position relative to cable 92, while at the same time retraction of cylinder 56 causes inner boom section 72 to be pulled into sleeve 66, with the appropriate boom sections moving relative to each other. Bolt 126 is then retightened, fixing the sections in place. In the event further extension is desired, tension on cable 92 is relieved, boom 70 is extended by cylinder 56, and the procedure is repeated. Once the boom 70 is placed in its desired position, cable 92 is released from pulley 128.

Retraction of the sections of boom 70 is performed using a loop member 134 welded to gusset beam 68. Hook 94 is connected to look member 134 as shown in FIG. 3, all bolts 126 are loosened, and winch 84 retracts cable 92. The retraction of cable 92 applies force against pulley 78, causing the boom sections to slide into one another, bringing boom 72 a fully retracted position.

Additionally, loop member 134 serves as a storage position for hook 94 and cable 92 when crane tool 16 is not being used.

Operation of the crane tool 16 for raising and lowering objects should be readily apparent from the foregoing description. Winch 84 is used to raise and lower hook 94, which is attached to the objects for which crane tool is to be used. Cylinder 56 enables boom 70 to be moved inwardly and outwardly for adjustments in position, and the conventional equipment provided as part of backhoe 10 for horizontally swinging arm 12 from side to side is used to move crane tool 16 in similar fashion.

While the preferred embodiment of the present invention provides a crane tool 16 connected to a multipurpose attachment 14 which is in turn mounted to the backhoe arm 12, it should be recognized that the present invention also encompasses a single-purpose backhoe attachment dedicated solely for use as a crane. In such a case, of course, the crane tool 16 and the attachment 14 as described herein would be constructed as a single, permanently-connected unit.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A crane tool for use with an attachment removably mounted to the arm of a backhoe machine from which the bucket has been removed, the backhoe further having a first hydraulic cylinder disposed along the arm normally for pivoting the bucket when in place on the arm and a controllable source of hydraulic fluid under pressure normally supplied to a second hydraulic cylinder on the backhoe arm, the attachment including a frame having a first end fittable on the backhoe arm and an outer end extending therebeyond, means for removably fastening the frame to the arm, a sliding member connectable with the end of the first cylinder for movement thereby along the frame, and guide means for directing the sliding member along the frame between the first and the outer ends, said crane tool comprising:

a sleeve;

means for removably mounting said sleeve to the frame such that said sleeve is directed substantially parallel to the backhoe arm;

a boom having an inner end insertable through and moveable along said sleeve and an outer end extending substantially beyond said sleeve;

means for connecting the inner end of said boom with said sliding member for movement of said boom along said sleeve in response to movement of said sliding member by the first cylinder;

a hydraulically-powered winch and a cable connected thereto, said winch being mounted to said sleeve and arranged for playing out and retracting said cable along said boom;

means for connecting said winch with the source of hydraulic fluid; and a pulley mounted for rotation at said outer end of said boom and receiving said cable for passage therearound.

2. A crane tool for use with an attachment removably mounted to the arm of a backhoe machine from which the bucket has been removed, the backhoe further having a first hydraulic cylinder disposed along the arm normally for pivoting the bucket when in place on the arm and a controllable source of hydraulic fluid under pressure normally supplied to a second hydraulic cylinder on the backhoe arm, the attachment including a frame having a first end fittable on the backhoe arm and an outer end extending therebeyond, means for removably fastening the frame to the arm, a sliding member connectable with the end of the first cylinder for movement thereby along the frame, and guide means for directing the sliding member along the frame between the first and the outer ends, said crane tool comprising:

a sleeve;

means for removably mounting said sleeve to the frame such that said sleeve is directed substantially parallel to the backhoe arm;

a boom having an inner end insertable through and moveable along said sleeve and an outer end extending substantially beyond said sleeve;

means for connecting the inner end of said boom with said sliding member for movement of said boom along said sleeve in response to movement of said sliding member by the first cylinder;

a hydraulically-powered winch and a cable connected thereto, said winch being mounted to said sleeve and arranged for playing out and retracting said cable along said boom;

means for connecting said winch with the source of hydraulic fluid; and a pulley mounted for rotation at said outer end of said boom and receiving said cable for passage therearound;

wherein the sliding member includes a support portion adapted for cooperation with the guide means for movement along the frame, a plate member having a substantially flat surface mounted to the support portion such that the flat surface is disposed substantially perpendicular to the direction of movement of the support portion along the frame, and a slot defined in the plate member, and wherein said means for connecting the inner end of said boom with the sliding member includes a projection extending from said inner end of said boom and insertable through the slot, and a pin connecting said projection to the support portion.

3. A crane attachment for removable mounting to the arm of a backhoe machine from which the bucket has been removed, the backhoe further having a first hydraulic cylinder disposed along the arm normally for pivoting the bucket when in place on the arm and a controllable source of hydraulic fluid under pressure normally supplied to a second hydraulic cylinder on the backhoe arm, said crane attachment comprising:

a frame having a first end fittable on the backhoe arm and an outer end extending therebeyond;

means for fastening said frame to the arm;

a sleeve;

means for mounting said sleeve to said frame whereby said sleeve is directed substantially parallel to the backhoe arm;

a boom having an inner end insertable through and movable along said sleeve and an outer end extending substantially beyond said sleeve;

means for connecting the inner end of said boom with the first hydraulic cylinder for movement of said boom along said sleeve;

said means for connecting the inner end of said boom with the first hydraulic cylinder including a sliding member connectable with the end of the first cylinder for movement thereby along said frame, guide means for directing said sliding member along said frame between said first end and said outer end, and means connecting the inner end of said boom with said sliding member;

a hydraulically-powered winch and a cable connected thereto, said winch being mounted to said sleeve and arranged for playing out and retracting said cable along said boom;

means connecting said winch with the source of hydraulic fluid; and a pulley mounted for rotation at said outer end of said boom and receiving of said cable for passage therearound.

4. A crane attachment for removable mounting to the arm of a backhoe machine from which the bucket has been removed, the backhoe further having a first hydraulic cylinder disposed along the arm normally for pivoting the bucket when in place on the arm and a controllable source of hydraulic fluid under pressure normally supplied to a second hydraulic cylinder on the backhoe arm, said crane attachment comprising:

a frame having a first end fittable on the backhoe arm and an outer end extending therebeyond;

means for fastening said frame to the arm;

a sleeve;

means for mounting said sleeve to said frame whereby said sleeve is directed substantially parallel to the backhoe: arm;

a boom having an inner end insertable through and movable along said sleeve and an outer end extending substantially beyond said sleeve;

means for connecting the inner end of said boom with the first hydraulic cylinder for movement of said boom along said sleeve;

said means for connecting the inner end of said boom with the first hydraulic cylinder including a sliding member connectable with the end of the first cylinder for movement thereby along said frame, guide means for directing said sliding member along said frame between said first end and said outer end, and means connecting the inner end of said boom with said sliding member;

said sliding member including a support portion adapted for cooperation with said guide means for movement along said frame, a plate member having a substantially flat surface mounted to said support portion such that said flat surface is disposed substantially perpendicular to the direction of movement of said support portion along said frame, and a slot defined in said plate member, and wherein said means for connecting the inner end of said boom with said sliding member includes a projection extending from said inner end of said boom and insertable through said slot, and a pin connecting said projection to said support portion;

a hydraulically-powered winch and a cable connected thereto, said winch being mounted to said sleeve and arranged for playing out and retracting said cable along said boom;

means connecting said winch with the source of hydraulic fluid; and a pulley mounted for rotation at said outer end of said boom and receiving of said cable for passage therearound.

* * * * *